US010710397B2

(12) United States Patent
Usui et al.

(10) Patent No.: US 10,710,397 B2
(45) Date of Patent: Jul. 14, 2020

(54) LINE DRAWING TOOL

(71) Applicants: TJM DESIGN CORPORATION, Tokyo (JP); PATENT ISLAND Corp., Shizuoka-ken (JP)

(72) Inventors: Hiroyuki Usui, Shizuoka (JP); Yutaka Mutai, Tokyo (JP)

(73) Assignees: TJM DESIGN CORPORATION, Tokyo (JP); PATENT ISLAND CORP., Shizuoka-ken (JP)

( * ) Notice: Subject to any disclaimer, the term of this patent is extended or adjusted under 35 U.S.C. 154(b) by 154 days.

(21) Appl. No.: 15/903,784

(22) Filed: Feb. 23, 2018

(65) Prior Publication Data

US 2018/0244100 A1 Aug. 30, 2018

(30) Foreign Application Priority Data

Feb. 27, 2017 (JP) ..... 2017-035177

(51) Int. Cl.
*B44D 3/38* (2006.01)
*B43L 13/00* (2006.01)

(52) U.S. Cl.
CPC ..... *B44D 3/38* (2013.01); *B43L 13/00* (2013.01)

(58) Field of Classification Search
CPC ..... B44D 3/38
USPC ..... 33/414
See application file for complete search history.

(56) References Cited

U.S. PATENT DOCUMENTS 1,555,167 A * 9/1925 Switzer ..... B44D 3/38 242/396.4
3,311,319 A * 3/1967 Campbell ..... B44D 3/38 242/394
3,438,595 A * 4/1969 West ..... A63C 19/08 242/394
3,888,010 A * 6/1975 Hyde ..... B44D 3/38 33/414
4,192,078 A * 3/1980 Lore ..... B44D 3/38 33/414
4,197,656 A * 4/1980 Lane ..... B44D 3/38 33/414
5,444,919 A * 8/1995 Alves ..... B44D 3/38 242/390.8
5,465,494 A * 11/1995 Johnston ..... B44D 3/38 33/413
6,098,299 A * 8/2000 Collins ..... B44D 3/38 24/122.3
6,393,709 B1 * 5/2002 Jones ..... B44D 3/38 33/414

(Continued)

FOREIGN PATENT DOCUMENTS

JP 2010-23226 A 2/2010

*Primary Examiner* — Yaritza Guadalupe-McCall
(74) *Attorney, Agent, or Firm* — Greenblum & Bernstein, P.L.C.

(57) ABSTRACT

A line drawing tool includes a body; a reel that is rotatably provided in the body and that includes flanges on two ends of a thread winding shaft; a thread that is wound around the thread winding shaft and that is drawn out to outside of the body with powder that is enclosed in the body being adhered to the thread; and a clearance that is formed between the flanges of the reel and the body, the clearance being provided for allowing the powder that accumulates between the body and the flanges to escape.

10 Claims, 8 Drawing Sheets

(56) References Cited

U.S. PATENT DOCUMENTS

| | | | | |
|---|---|---|---|---|
| 2016/0167425 | A1* | 6/2016 | Chernyshou | C09D 13/00 33/414 |
| 2018/0244100 | A1* | 8/2018 | Usui | B43L 13/00 |

* cited by examiner

LINE DRAWING TOOL

BACKGROUND OF THE INVENTION

1. Field of the Invention

The present invention relates to a line drawing tool. The present application claims priority based on Japanese Patent Application No. 2017-35177, filed on Feb. 27, 2017 in Japan, the contents of which are incorporated in the present application.

2. Description of the Related Art

Hitherto, a line drawing tool that performs a line drawing operation by using a thread having powder adhered thereto has been known. A line drawing tool of this type is mentioned in, for example, Japanese Unexamined Patent Application Publication No. 2010-23226. The line drawing tool includes a body; a reel that is rotatably provided in the body and that has flat flanges on two ends of a thread winding shaft; a powder that is enclosed in the body; and a thread that is wound around the thread winding shaft and that is drawn out to the outside of the body with powder adhered to the thread.

A line drawing operation using a line drawing tool is performed by the following procedure.

A fixing tool (hook) that is mounted on an end of a thread is fixed to one of the drawing reference points of a member.

By moving the body, the reel is freely rotated to draw out the thread from the body.

Powder that has been stirred by the rotation of the reel adheres to the thread.

The body is moved to a desired location, which is the other reference point.

The thread stretched between the fixing tool and the body is flicked with a finger towards a surface of the member to transfer a powder line (powder strike line).

The transfer is sometimes performed a plurality of times with the thread drawn out from the body.

The larger the amount of powder adhering to the thread is, the larger the number of times the powder line can be transferred.

After completing the drawing operation, while rotating the reel by using a handle and rewinding the thread, a user comes near the fixing tool mounted on the member and removes the fixing tool from the reference point.

In the line drawing tool having the above-described structure, the powder may get clogged between an inner surface of the body and the flat flanges of the reel. When the powder gets clogged, the resistance that is produced when the reel is rotated by using the handle may be increased. In particular, when the thread is thickened to increase the amount of powder adhering to the thread, the resistance that is produced when the thread is rewound around the reel is further increased. As a result, the resistance that is produced when the reel is rotated by using the handle is further increased.

BRIEF SUMMARY OF THE INVENTION

The present invention includes a body; a reel that is rotatably provided in the body and that includes flanges on two ends of a thread winding shaft;

a thread that is wound around the thread winding shaft and that is drawn out to outside of the body with powder that is enclosed in the body being adhered to the thread; and a clearance that is formed between the flanges of the reel and the body, the clearance being provided for allowing the powder that accumulates between the body and the flanges to escape.

DETAILED DESCRIPTION OF THE INVENTION

A line drawing tool 10 according to an embodiment is described in detail on the basis of the drawings.

Figure 1:
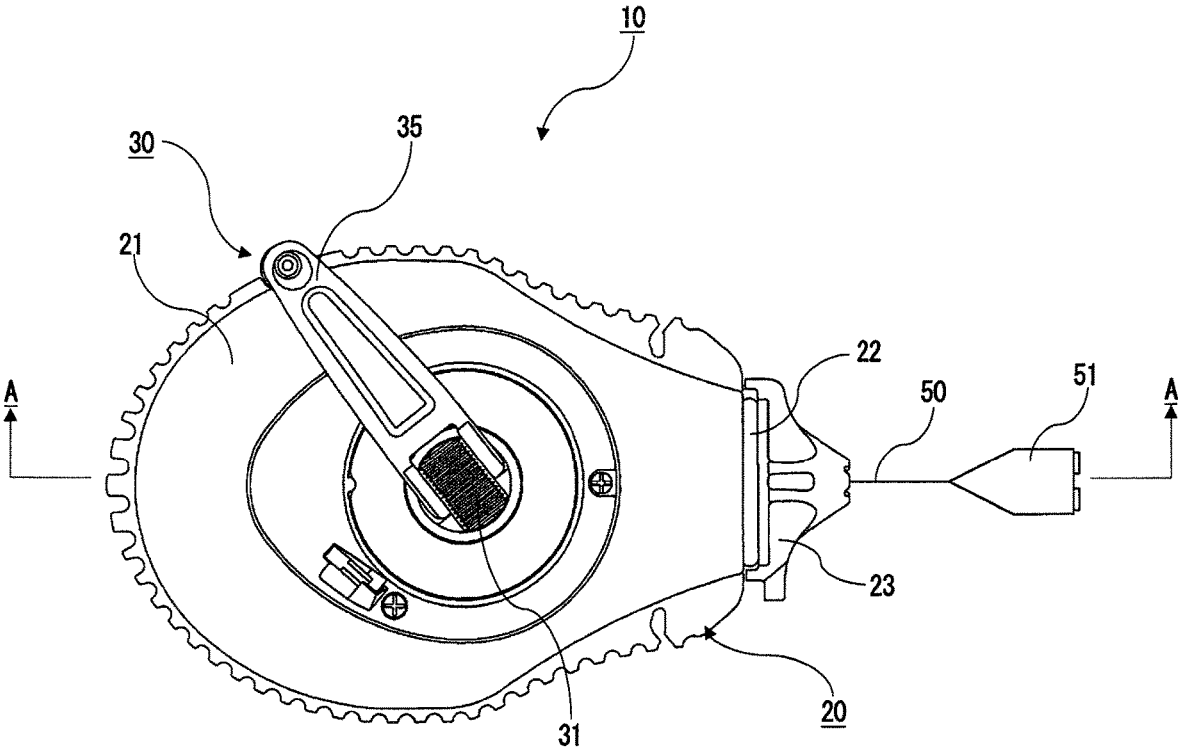
FIG. 1 is a plan view of a line drawing tool according to an embodiment of the present invention.
Figure 2:
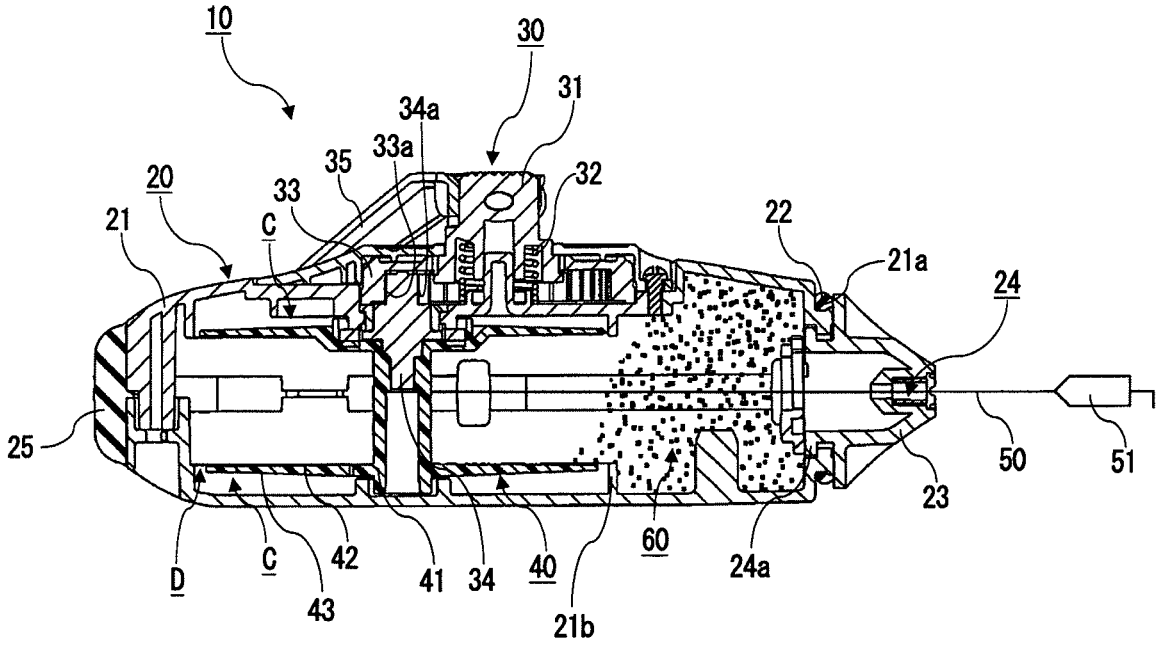
FIG. 2 is a sectional view taken along A-A of the line drawing tool according to the embodiment of the present invention.

As shown in FIGS. 1 and 2, the line drawing tool 10 according to the embodiment includes a body 20, a handle 30 that is provided on an outer side of the body 20, a reel 40 that is rotatably disposed in the body 20 and to which rotation force from the handle 30 is transmitted, a thread 50 that is wound around the reel 40, and a powder 60 that is accommodated in the body 20.

The body 20 includes a pair of housings 21 (case-half bodies). The pair of housings 21 are connected to each other as an integrated body via a holding portion 25 that is made of a rubber-like elastic material. The body 20 includes an opening portion for drawing out the thread 50 towards the front. The reel 40 is rotatably disposed at a rear portion of the inside of the body 20. A cap 23 is provided in an opening end portion of the opening portion of the body 20, and a packing mounting groove 21*a* is formed at an outer peripheral side thereof. An annular packing 22, which is made of a rubber-like elastic material, is provided in the packing mounting groove 21*a*.

The cap 23 is made of, for example, synthetic resin. The cap 23 includes a sponge (not shown) that adjusts the amount of powder 60 adhered to the thread 50, a thread draw-out opening 24 for drawing out the thread 50 to the outside of the body 20, and an engaging portion 24*a* that engages the body 20 and the cap 23 with each other. The cap 23 is mounted on the body 20 by rotating the cap 23 in a peripheral direction after inserting the engaging portion 24*a* in an inner surface of the opening portion of the body 20.

The handle 30 is mounted on the outer side of the body 20 and is disposed perpendicularly to the body 20. The handle 30 includes a spline shaft 31, a spring 32, an outer gear 33, and an inner gear 34. A lower end side (lower side in FIG. 2) of the spline shaft 31 includes a plurality of spline grooves that are spaced apart from each other at a predetermined interval in a peripheral direction: The spring 32 is mounted on the spline shaft 31. The outer gear 33 and the spline shaft 31 are concentrically disposed. The outer gear 33 includes inwardly facing protrusions that engage with the spline grooves of the spline shaft 31 at an axial center. The outer gear 33 includes an internal gear 33*a* extending from an outer-peripheral-side end portion towards the body 20 in an axial direction. The inner gear 34 includes an external gear 34*a* to which rotation force from the outer gear 33 is transmitted by engaging with the internal gear 33*a* of the outer gear 33. By connecting the inner gear 34 with an axial center of the reel 40, the rotation force is transmitted to the reel 40 from the outer gear 33. An arm 35 for rotating the handle 30 by a user of the line drawing tool 10 is mounted on an outer side of the spline shaft 31 in the axial direction (upper side in FIG. 2) via a hinge so as to be capable of rising and falling. A knob for being grabbed by finger tips is mounted on an end of the arm 35 so as to be rotatable in a peripheral direction.

The operation is as follows. By rotating the above-described handle 30 and transmitting the rotation force thereof to the reel 40, the thread 50 is wound around the reel 40. When the outer gear 33 and the inner gear 34, which have different numbers of teeth, engage with each other, the winding speed of the thread 50 can be increased.

By pressing the spline shaft 31 in the axial direction, it is possible to disengage the spline grooves of the spline shaft 31 and the inwardly facing protrusions of the outer gear 33 from each other, and intercept the transmission of the rotation force from the handle 30 to the reel 40. When the pressing of the spline shaft 31 is stopped; the spline grooves of the spline shaft 31 and the inwardly facing protrusions of the outer gear 33 can be kept in the engaged state by an elastic restoring force of the spring 32. Therefore, by pressing the spline shaft 31, the reel. 40 is set in a freely rotatable state, and the thread 50 can be drawn out from the body 20 without rotating the handle 30.

Figure 3:
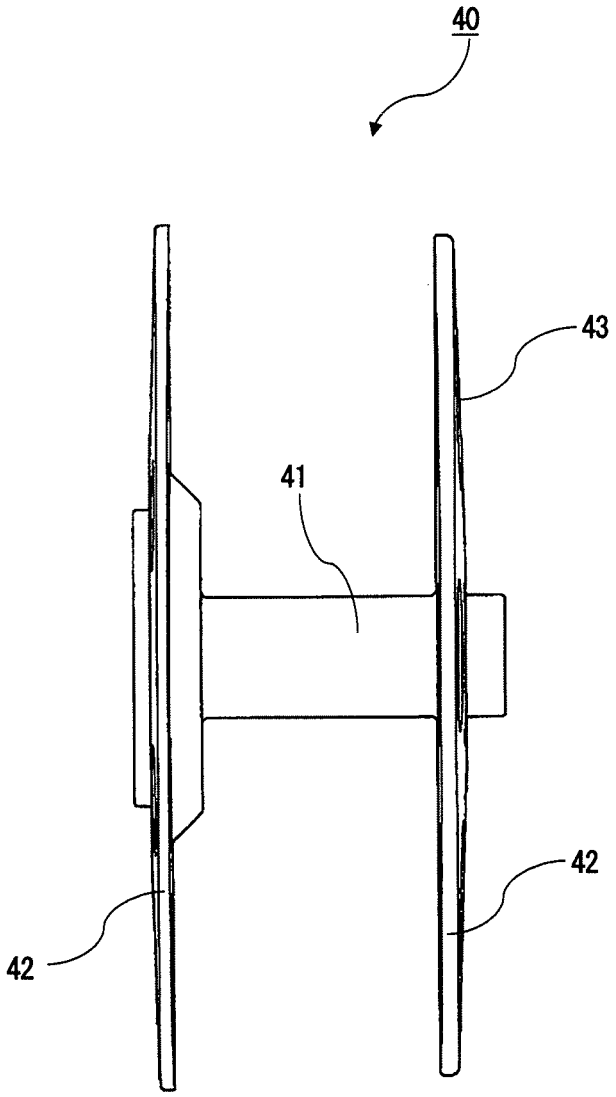
FIG. 3 is a side view of a reel of the line drawing tool according to the embodiment of the present invention.

As shown in FIG. 3, the reel 40 is made of, for example, synthetic resin, and includes a thread winding shaft 41 around which the thread 50 is wound and a pair of flanges 42 that extend in an outside diameter direction from two ends in the axial direction of the thread winding shaft 41. The thread winding shaft 41 and the pair of flanges 42 are integrated with each other.

The thread winding shaft 41 is a circular cylindrical member. A shaft portion of the inner gear 34 is inserted into one of the end portions of the thread winding shaft 41 in the axial direction, and engages therewith in a peripheral direction.

Each flange 42 is formed from a disc-shaped member. Each flange 42 includes a tapered portion 43 that gradually inclines in the outside diameter direction from the center of the thread winding shaft 41 so as to extend away from the body 20. A surface of each flange 42 has circular holes 44 in a plane as those shown in FIG. 4. The circular holes 44 are spaced apart from each other by a predetermined interval in a peripheral direction. Each flange 42 is covered by an annular wall surface 21*b*. A gap D is provided between an inner peripheral surface of the wall surface 21*b* and an outer peripheral surface of each flange 42.

Figure 4:
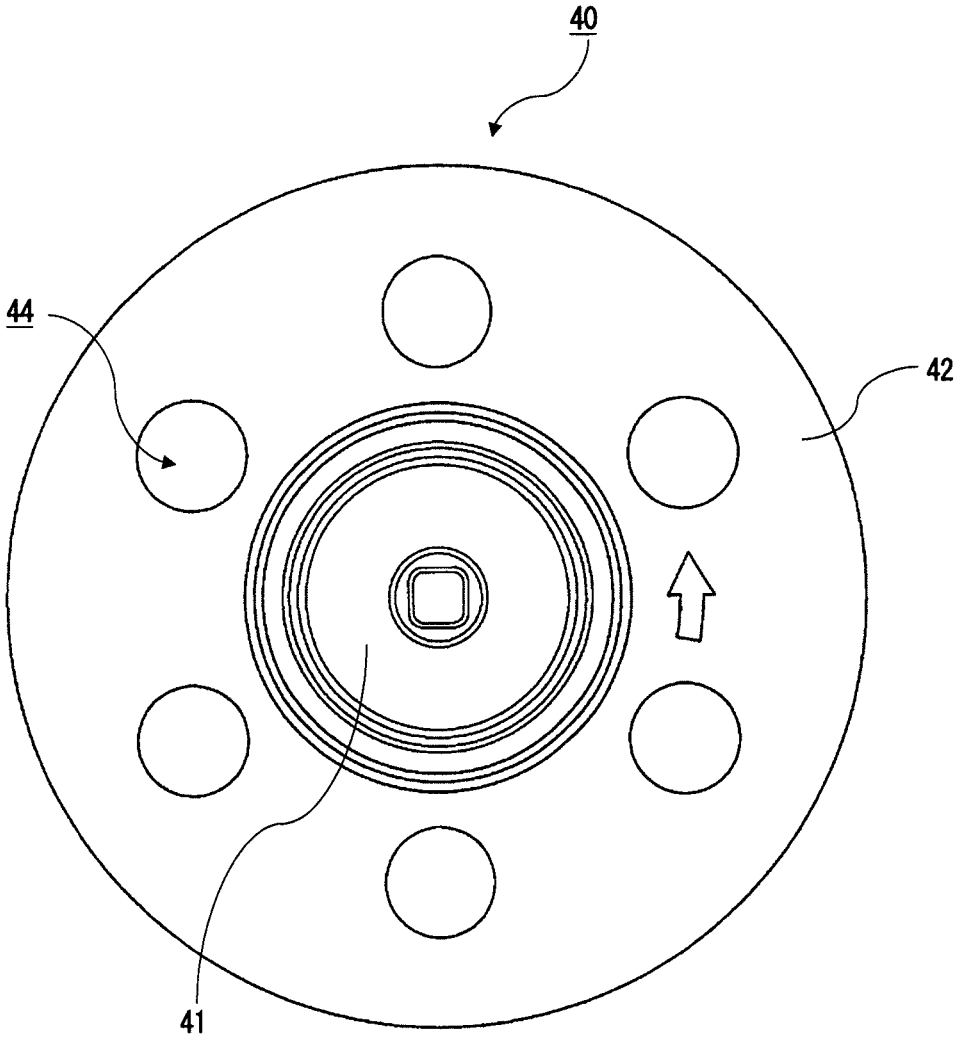
FIG. 4 is a plan view of a first example of a reel of the line drawing tool according to the embodiment of the present invention.
Figure 5:
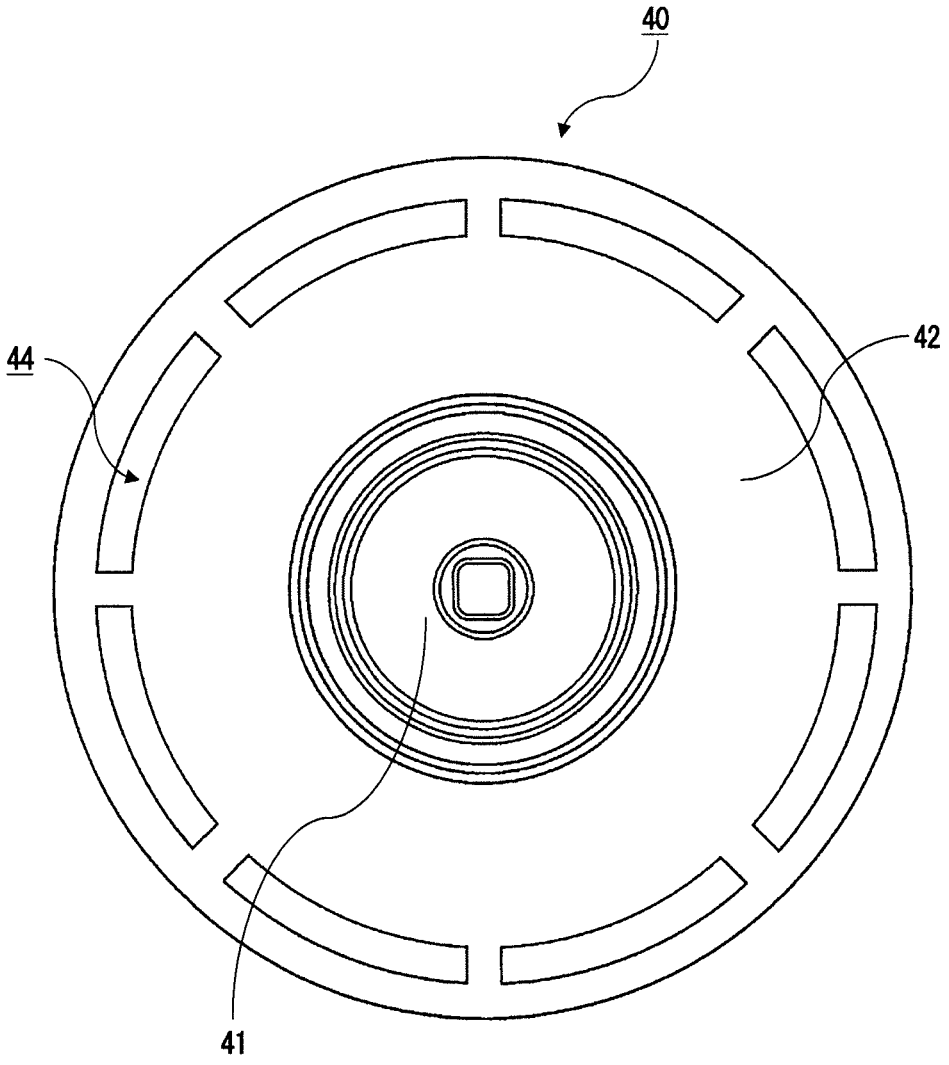
FIG. 5 is a plan view of a second example of a reel of the line drawing tool according to the embodiment of the present invention.
Figure 6:
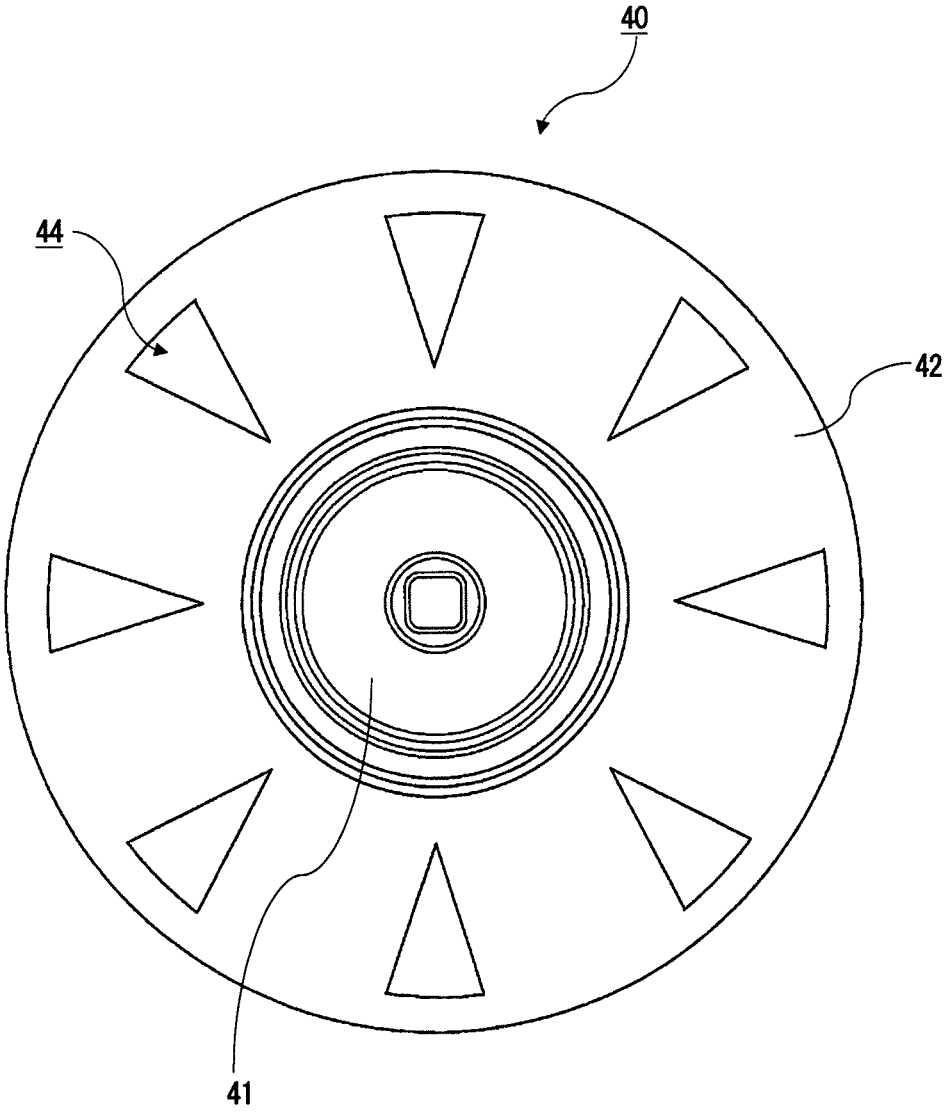
FIG. 6 is a plan view of a third example of a reel of the line drawing tool according to the embodiment of the present invention.

The form of the holes 44 that are formed in the surface of each flange 42 is not limited to the form shown in FIG. 4. For example, as shown in FIG. 5, the holes 44 may have the form of slits that are formed from the vicinity of an outer-peripheral-side end portion of each flange 42 at a predetermined interval in a peripheral direction. As shown in FIG. 6, the holes 44 may have a substantially triangular shape in a plane such that their widths become gradually larger in the outside diameter direction from the axial center of the thread winding shaft 41.

A clearance C for allowing the powder 60 to escape is formed between the tapered portions 43 of the flanges 42 and an inner side of the body 20. The clearance C communicates with the holes 44 that are formed in the flanges 42. The clearance C communicates with the gap D that is provided between the outer peripheral surface of each flange 42 and the inner peripheral surface of the wall surface 21*b*.

The thread 50 includes raw threads made of fiber, such as polyester or nylon, that are spun, and the powder 60 is capable of adhering to the surface of the thread 50. A hook 51 for being fixed to a member (not shown) is mounted on an end of the thread. 50.

The powder 60 is enclosed in the inside of the body 20. It is desirable that the amount of powder 60 generally be in the range of 70% to 80% with respect to an internal space of the body 20. The powder 60 is stirred due to its self-weight and the rotation force produced when the handle 30 is rotated, and adheres to the thread 50.

The procedure for performing a drawing operation using the line drawing tool 10 according to the embodiment is described.

First, the hook 51 is fixed to one of the drawing reference points on the member.

Next, by pressing the spline shaft 31 in the axial direction, the spline grooves of the spline shaft 31 and the inwardly facing protrusions of the outer gear 33 are disengaged from each other. This causes the reel 40 to be in a freely rotatable state.

Next, the thread 50 is drawn out while freely rotating the reel 40 by moving the body 20. During this process, the powder 60 that has been stirred due to the rotation of the reel 40 adheres to the thread 50.

Next, when the body 20 has been moved to a desired location, which is the other drawing reference point, the thread 50 that has been stretched between the hook 51 and the body 20 along a surface of the member is flicked with a finger towards and is struck against the surface of the member. This causes a powder-60 line (powder strike line) to be transferred.

After completing the desired line drawing operation, the arm 35 of the handle 30 is raised from the state shown in FIGS. 1 and 2. By rotating the reel 40 by using the handle 30, the thread 50 is wound around the reel 40. A user comes near the hook 51 mounted on the member and removes the hook 51 from the reference point.

At this time, the powder 60 enclosed in the inside of the body 20 moves towards an outer periphery in the clearance C between the body 20 and each flange 42 of the reel 40 due to the centrifugal force produced by the rotation of the reel 40 and the self-weight of the powder 60. Since the size of the clearance C increases in the axial direction with decreasing distance from the outer periphery, the powder 60 does not get clogged.

Accordingly, according to the line drawing tool 10 according to the embodiment, each flange 42 includes the corresponding tapered portion 43 that inclines in the outside diameter direction from the center of the thread winding shaft 41 so as to extend away from the body 20. Therefore, the clearance C between the body 20 and the reel 40 can be made larger than in a line drawing tool including flat flanges according to the related art. The rotation of the reel 40 causes the powder 60 to move in the direction of the gap D along the tapered portion 43 of each flange 42. Therefore, it is possible to prevent the powder 60 from getting clogged between an inner surface of the body 20 and the reel 40. Consequently, it is possible to prevent the resistance that is produced when the reel 40 is rotated by using the handle 30 from becoming large.

In particular, the line drawing tool 10 according to the embodiment is useful in a case in which the resistance that is produced when the thread 50 is wound around the reel 40 becomes large as a result of increasing the diameter of the thread 50 for increasing the amount of powder 60 adhering to the thread 50.

The line drawing tool 10 according to the embodiment is useful in a case in which the torque of the arm 35 of the handle 30 becomes large for increasing the winding speed when the long thread 50 is wound around the reel 40.

According to the line drawing tool 10 of the embodiment, it is no longer necessary to reduce the amount of powder 60 for preventing the powder 60 from getting clogged between the body 20 and the reel 40. Therefore, it is possible to enclose the powder 60 of the usual amount in the body 20.

Figure 7:
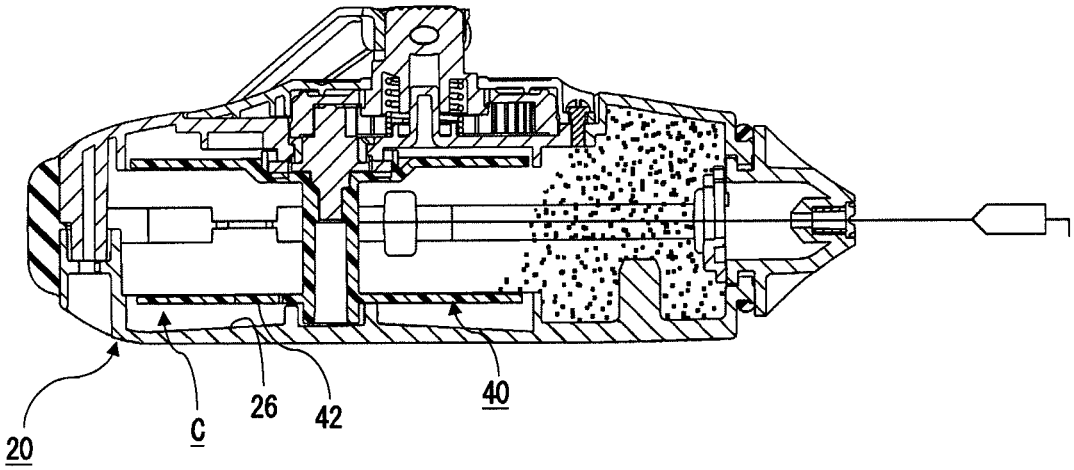
FIG. 7 is a sectional view along A-A of a line drawing tool according to another embodiment of the present invention.

In a different embodiment, instead of providing the reel 40 with the tapered portions 43, as shown in FIG. 7, an inner surface of a body 20 facing flanges 42 may have tapered shapes 26. The distance between each tapered shape 26 and the corresponding flange 42 increases with decreasing distance from an outer peripheral surface of each flange 42. This makes it possible to increase the size of a clearance C between the body 20 and the reel 40 as in the case where the reel 40 is provided with the tapered portions 43.

Figure 8:
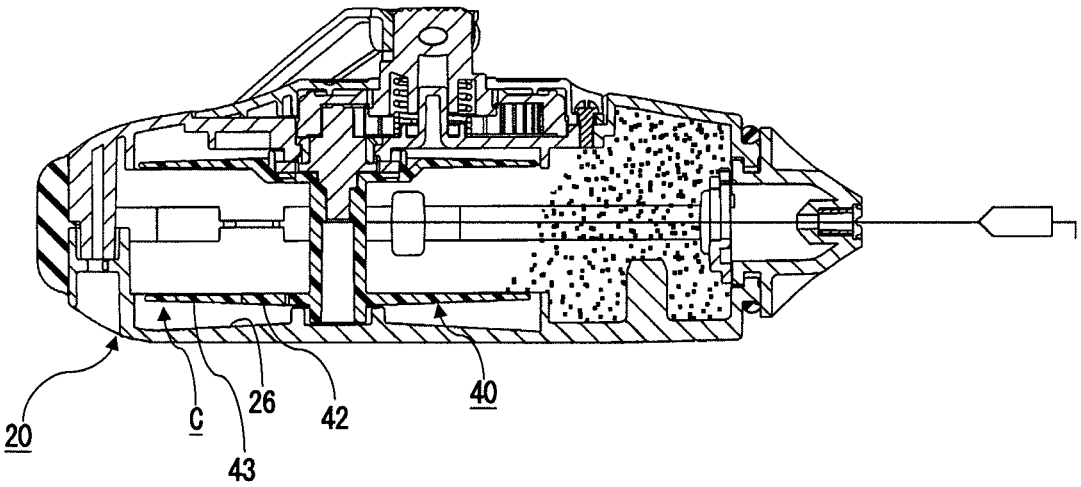
FIG. 8 is a sectional view along A-A of a line drawing tool according to still another embodiment of the present invention.

In still a different embodiment, as shown in FIG. 8, a reel 40 may include tapered portions 43, and an inner surface of a body 20 facing flanges 42 may have tapered shapes 26. This makes it possible to further increase the size of a clearance C between the body 20 and the reel 40.

The forms of tapers, the holes, and the body that is inclined in a direction away from the flanges of the reel are not limited to the above-described forms as long as it is possible to form a clearance for allowing powder to escape between the body and the reel.

What is claimed is:

1. A line drawing tool comprising:

a body;

a reel that is rotatably provided in the body and that includes flanges on two ends of a thread winding shaft;

a thread that is wound around the thread winding shaft and that is drawn out to outside of the body with powder that is enclosed in the body being adhered to the thread; and a clearance that is formed between the flanges of the reel and the body, the clearance being provided to allow the powder that accumulates between the body and the flanges to escape, wherein a width of the clearance in an axial direction between the body and each flange increases from an axial center of the thread winding shaft towards an outside diameter.

2. The line drawing tool according to claim 1, wherein each flange includes a hole that communicates with the clearance.

3. The line drawing tool according to claim 2, wherein the width of the clearance in the axial direction between the body and each flange increases towards the outside diameter due to each flange inclining from the axial center of the thread winding shaft towards an outer periphery.

4. The line drawing tool according to claim 3, wherein the width of the clearance in the axial direction between the body and each flange increases from the axial center of the thread winding shaft towards the outside diameter due to an inner surface of the body facing each flange of the reel in the axial direction inclining in a direction away from each flange of the reel.

5. The line drawing tool according to claim 2, wherein the width of the clearance in the axial direction between the body and each flange increases from the axial center of the thread winding shaft towards the outside diameter due to an inner surface of the body facing each flange of the reel in the axial direction inclining in a direction away from each flange of the reel.

6. The line drawing tool according to claim 1, wherein the width of the clearance in the axial direction between the body and each flange increases towards the outside diameter due to each flange inclining from the axial center of the thread winding shaft towards an outer periphery.

7. The line drawing tool according to claim 6, wherein the width of the clearance in the axial direction between the body and each flange increases from the axial center of the thread winding shaft towards the outside diameter due to an inner surface of the body facing each flange of the reel in the axial direction inclining in a direction away from each flange of the reel.

8. The line drawing tool according to claim 1, wherein the width of the clearance in the axial direction between the body and each flange increases from the axial center of the thread winding shaft towards the outside diameter due to an inner surface of the body facing each flange of the reel in the axial direction inclining in a direction away from each flange of the reel.

9. The line drawing tool according to claim 1, wherein each flange is respectively covered by an annular wall that is inside the body and that projects inward from an inner surface of the body.

10. The line drawing tool according to claim 9, wherein the annular wall covers the width of the clearance in the axial direction.

* * * * *